US011384968B2

(12) United States Patent
Nicklasson et al.

(10) Patent No.: US 11,384,968 B2
(45) Date of Patent: Jul. 12, 2022

(54) METHOD FOR CONTROLLING A HEAT PUMP SYSTEM

(71) Applicant: Ningbo Geely Automobile Research & Development Co., Ltd., Ningbo (CN)

(72) Inventors: Kristian Nicklasson, Åsa (SE); Johan Hellsing, Hisings Kärra (SE)

(73) Assignee: NINGBO GEELY AUTOMOBILE RESEARCH & DEVELOPMENT CO. LTD., Ningbo (CN)

( * ) Notice: Subject to any disclaimer, the term of this patent is extended or adjusted under 35 U.S.C. 154(b) by 111 days.

(21) Appl. No.: 16/706,299

(22) Filed: Dec. 6, 2019

(65) Prior Publication Data

US 2020/0116399 A1 Apr. 16, 2020

Related U.S. Application Data

(63) Continuation of application No. PCT/CN2018/086728, filed on May 14, 2018.

(30) Foreign Application Priority Data

Jul. 3, 2017 (EP) ..... 17179286

(51) Int. Cl.
*F25B 27/02* (2006.01)
*F25B 25/00* (2006.01)
(Continued)

(52) U.S. Cl.
CPC ..... *F25B 27/02* (2013.01); *F25B 25/00* (2013.01); *F25B 30/02* (2013.01); *F25B 31/006* (2013.01);
(Continued)

(58) Field of Classification Search
CPC ..... F25B 27/02; F25B 25/00; F25B 30/02; F25B 31/006; F25B 49/025;
(Continued)

(56) References Cited

U.S. PATENT DOCUMENTS

2008/0072619 A1* 3/2008 Nojima ..... F25B 49/025 62/498
2012/0031079 A1 2/2012 Spicer

FOREIGN PATENT DOCUMENTS

CN 1365430 A 8/2002
CN 101022215 A 8/2007
(Continued)

OTHER PUBLICATIONS

Translation of CN 104596171A.*
(Continued)

*Primary Examiner* — Elizabeth J Martin
(74) *Attorney, Agent, or Firm* — Tucker Ellis LLP

(57) ABSTRACT

A method for controlling a heat pump system. The heat pump system includes a compressor for compressing a working fluid of the heat pump system and an electric motor for providing an output torque for driving the compressor. The method includes the steps of recovering heat emitted from the electric motor by heating the working fluid, providing a first control mode and a second control mode for the electric motor, and controlling the electrical motor in a way creating higher heat losses of the electric motor for a given output torque of the electric motor in the second control mode than in the first control mode.

18 Claims, 4 Drawing Sheets

(51) Int. Cl.
*F25B 30/02* (2006.01)
*F25B 31/00* (2006.01)
*F25B 49/02* (2006.01)

(52) U.S. Cl.
CPC ..... *F25B 49/025* (2013.01); *F25B 2313/008* (2013.01)

(58) Field of Classification Search
CPC ..... F25B 2313/008; F25B 2400/0411; F25B 25/005; F25B 40/06; F25B 2400/072
See application file for complete search history.

(56) References Cited

FOREIGN PATENT DOCUMENTS

| | | | | |
|---|---|---|---|---|
| CN | 103430433 | A | | 12/2013 |
| CN | 104596171 | A | * | 12/2014 |
| CN | 104596171 | A | | 5/2015 |
| CN | 104654527 | A | | 5/2015 |
| CN | 106059155 | A | | 10/2016 |
| DE | 102013225450 | B3 | | 3/2015 |
| JP | 0345850 | A | | 2/1991 |
| JP | 2016077093 | A | | 5/2016 |
| WO | 2014151375 | A1 | | 9/2014 |
| WO | 2014200476 | A1 | | 12/2014 |
| WO | 2016029528 | A1 | | 3/2016 |
| WO | 2016170578 | A1 | | 10/2016 |

OTHER PUBLICATIONS

International Search Report and Written Opinion from corresponding International Patent Application No. PCT/CN2018/086728, dated Jul. 27, 2018, 11 pages.
Extended European Search Report from corresponding European Patent Application No. 17179286.4, dated Dec. 4, 2017, pages.

* cited by examiner

METHOD FOR CONTROLLING A HEAT PUMP SYSTEM

RELATED APPLICATION DATA

This application is a continuation of International Patent Application No. PCT/CN2018/086728, filed May 14, 2018, which claims the benefit of European Patent Application No. 17179286.4, filed Jul. 3, 2017, the disclosures of which are incorporated herein by reference in their entireties.

TECHNICAL FIELD

The invention relates to a method and a control unit for controlling a heat pump system. In addition, the invention relates to a vehicle comprising such a control unit.

BACKGROUND

Electric vehicles are usually provided with a system for heating, ventilation and air conditioning (HVAC-system), and preferably a heat pump system is used for heating/cooling. In some cases, the heating capacity of such a heat pump system is not sufficient to provide the requisite thermal energy. For example, at a very low ambient temperature, the heating capacity of the heat pump system may not be sufficient for achieving the desired temperature of a passenger compartment of a battery electric vehicle (BEV) or a plug-in hybrid electric vehicle (PHEV). This problem is usually solved by providing an additional electrical heater. The additional electric heater heats a working fluid and the heat is then transferred to the vehicle cabin via a so-called heater core.

SUMMARY

An objective of the invention is to provide a method for controlling a heat pump system by which method the performance of the heat pump system can be improved.

The objective is achieved by a method for controlling a heat pump system, wherein the heat pump system comprising a compressor for compressing a working fluid of the heat pump system and an electric motor for providing an output torque for driving the compressor, comprising the step of recovering heat emitted from the electric motor by heating the working fluid, providing a first control mode and a second control mode for the electric motor, and controlling the electrical motor in a way creating higher heat losses of the electric motor for a given output torque of the electric motor in the second control mode than in the first control mode.

The invention is based on the insight that the electric motor driving a compressor of a heat pump system can be controlled in a non-optimal way for meeting a heat demand. For example, at circumstances when the heating capacity of the heat pump system is not sufficient, increasing the heat losses of the electric motor and recovering the heat emitted from the electric motor by heating the working fluid, may result in a higher heat output from the heat pump system (at the same time as the efficiency of the heat pump system is decreased since more electric power is used). In other words, the maximal heating capacity can be increased while the coefficient of performance (COP) of the heat pump system is decreased. This is favorable since an additional heater provided for adding heat only when the ambient temperature is very low can be omitted. This in turn gives a less complicated HVAC-system design at lower cost.

Thus, the "non-optimal" control of the electric motor is related to the efficiency of the electric motor, i.e. the amount of heat losses compared to the output torque provided by the electric motor, whereas the performance of the heat pump system can be improved when the electric motor is run in the second control mode and heat emitted from the electric motor is recovered by heating the working fluid of the heat pump system.

According to one embodiment of the method, the electric motor is controlled according to the second control mode upon receiving a control signal indicating that a predetermined condition is fulfilled. Hereby, the electric motor can be run with high efficiency according to the first control mode and be switched to the second control mode when there is a need of additional heating of the working fluid of the heat pump system. When no additional heating is requested, the first control mode is preferably used by a default setting where the electric motor is run with highest possible efficiency, for example at or close to the MTPA-line (maximum torque per ampere).

According to a further embodiment of the method, the electric motor is controlled according to the second control mode upon receiving said control signal indicating a heating capacity demand on the heat pump system exceeding a threshold value. For example, if the ambient temperature is very low the heating capacity of the heat pump system may not be sufficient to provide the heat required for achieving the desired temperature of a passenger compartment of a vehicle. Then, the electric motor of the compressor can be driven at least temporarily in the second control mode to fulfil the heating capacity demand.

According to a further embodiment of the method, the electric motor is controlled according to the second control mode upon receiving said control signal indicating an amount of the working fluid, to be entered into the compressor, being in liquid state exceeding a threshold value. Hereby, the working fluid can be heated by means of the electric motor to achieve vaporization of the working fluid and avoid liquid compression in the compressor of the heat pump system at low ambient temperatures and/or when starting up the system.

According to a further embodiment of the method, the electric motor is controlled according to the second control mode upon receiving said control signal indicating a temperature and/or pressure of the working fluid below a threshold value. For example, when starting up the system, the temperature and pressure is a good indication on the occurrence of working fluid being in the liquid state. By a temperature and/or pressure sensor the need of heating the working fluid by means of the electric motor can be indicated.

Thus, the electric motor can be used as a heat source also when the temperature of the working fluid of the heat pump system should be increased for any other reason than a heating capacity demand on the heat pump system.

Another example where the electric motor can be controlled according to the second control mode is at low ambient temperature, where the evaporator of the heat pump system may need to be defrosted. Instead of using any additional heating device during a defrost mode, the temperature of the working fluid can be increased by heat from the electric motor for defrosting the evaporator.

According to a further embodiment of the method, the electric motor is controlled in a way resulting in a higher stator current for a given output torque of the electric motor in the second control mode than in the first control mode.

Hereby, increased heat losses of the stator of the electric motor can be achieved in the second control mode.

According to a further embodiment of the method, the electric motor is controlled in a way creating higher heat losses of stator windings of the electric motor for a given output torque of the electric motor in the second control mode than in the first control mode. Hereby, a major difference in heat losses of the electric motor between the first control mode and the second control mode can be achieved.

The heat loss in the windings is increased when the electric current in the windings is increased and maximum heat loss is determined by the maximum current allowed. This in turn is dependent on the conductor wire of the windings and the capacity of the cooling system of the electric motor.

According to a further embodiment of the method, the electric motor is controlled with a first stator current angle in the first control mode and with a second stator current angle in the second control mode, for a given output torque of the electric motor, where the second stator current angle requires a higher stator current than the first stator current angle. By using a non-optimal stator current angle, the current needed for maintaining the requisite output torque can be increased. The increased current involves increased heat losses. In other words; by changing the stator current angle, the operation of the electric motor is moved to a less efficient operation point which is situated longer from the most efficient point on the MTPA-line. This is preferably achieved by using a larger stator current angle in the second control mode than in the first control mode.

According to a further embodiment of the method, the electric motor is controlled in a way creating higher heat losses of a stator core of the electric motor for a given output torque of the electric motor in the second control mode than in the first control mode. In addition or as an alternative to increased heat losses of the stator windings, the second control mode may involve stator core heat losses for transferring heat to the working fluid of the heat pump system as described hereinabove.

According to a further embodiment of the method, the electric motor is controlled with a stator current having a substantially sinusoidal periodic waveform in the first control mode, and with a stator current having a non-sinusoidal periodic waveform in the second control mode. Hereby, the heat losses in the second control mode will be increased since the non-sinusoidal waveform is associated with increased stator core heat losses. Accordingly, the stator current has to be increased to maintain the desired output torque of the electric motor.

According to a further embodiment of the method, the electric motor is controlled with the stator current having a substantially square waveform in the second mode. Hereby, it is possible to obtain increased heat losses in the second control mode using a non-complicated control strategy.

According to a further aspect of the invention, a further objective is to provide a control unit for controlling a heat pump system by which control unit the performance of the heat pump system can be improved.

This objective is achieved by a control unit for controlling a heat pump system, wherein the heat pump system comprises a compressor for compressing a working fluid of the heat pump system, an electric motor for providing an output torque for driving the compressor and a means for recovering heat emitted from the electric motor by heating the working fluid, and the control unit is configured to provide a first control mode and a second control mode for the electric motor, and configured to control the electric motor in a way creating higher heat losses of the electric motor for a given output torque of the electric motor in the second control mode than in the first control mode.

The advantages of the control unit are similar to the advantages already discussed hereinabove with reference to the different embodiments of the method. Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS

Figure 1:
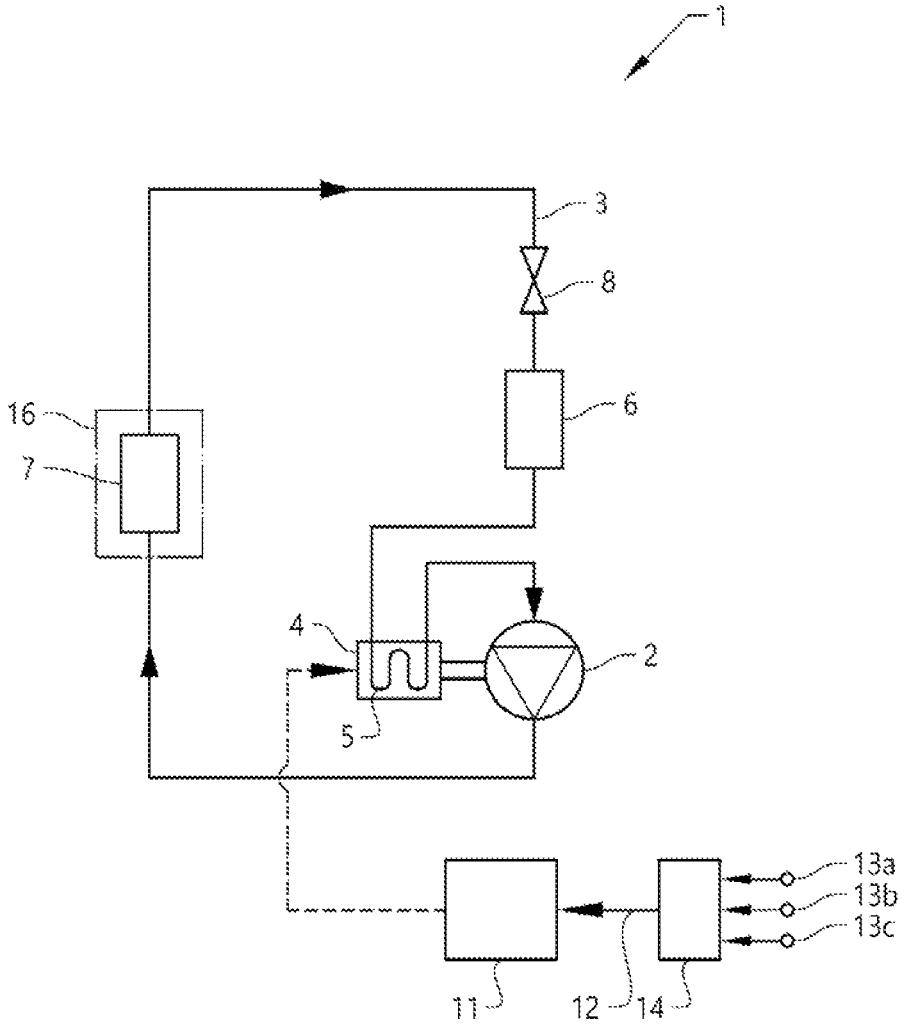
FIG. 1 is a schematic view of an example embodiment of a heat pump system to which the method according to the invention can be applied.

FIG. 1 illustrates a heat pump system 1. The heat pump system comprises a compressor 2 for compressing a working fluid 3 of the heat pump system, an electric motor 4 for providing an output torque for driving the compressor 2 and a means 5 for recovering heat emitted from the electric motor 4 by heating the working fluid 3. The compressor 2 has to operate at different compressor speeds. The requested speed is provided by controlling the electric motor 4 driving the compressor 2. At each speed, a certain torque will be required. Thus, in order to maintain the requested compressor speed, the electric motor has to provide a torque determined by the load from the compressor. For example, the electric motor can be of the type PMSM (Permanent Magnet Synchronous Motor) or BLDC (Brushless DC motor).

The heat pump system 1 further comprises an evaporator 6 where the working fluid 3 is heated by heat from the surrounding, a condenser 7 where heat is transferred from the working fluid to the surrounding, and a pressure lowering device 8 such as an expansion valve for lowering the pressure of the working fluid 3.

The operating principle of the heat pump system can be as follows. The working fluid 3 being in gaseous state is pressurized and circulated through the system by the compressor 2. After passing the compressor 2 the hot and highly pressurized working fluid 3 is cooled in the condenser 7, which is a heat exchanger, until the working fluid 3 condenses into a high-pressure liquid having a lower temperature. The condensed working fluid 3 then passes through the pressure-lowering device 8. The low-pressure working fluid then enters the evaporator 6, which is another heat exchanger, where the working fluid 3 absorbs heat and is evaporated. Thereafter, the working fluid 3 returns to the compressor 2 and the cycle is repeated.

As is schematically illustrated in FIG. 1, the working fluid 3 will also pass close to the electric motor 4 by means of the heat recovering means 5 before entering the compressor 2. The heat recovering means 5 is suitably some kind of heat exchanger for transferring heat from the electric motor 4 to the working fluid 3. Thus, the working fluid 3 functions as a coolant for the electric motor 4 driving the compressor 2. Although not illustrated, not only the electric motor 4 but also the compressor 2 can be cooled by the working fluid 3 for transferring friction heat from the compressor to the working fluid. In addition, any heat emitted from power electronics associated with the electric motor 4 can be transferred to the working fluid 3.

When the heat pump system 1 is applied on a vehicle, the condenser 7 transfers heat to the passenger compartment and/or to any other component such as batteries of the vehicle. The passenger compartment 16 is schematically indicated in FIG. 1. The heat transfer can be performed directly, i.e. from the working fluid 3 to air, or indirectly via another working medium.

The working fluid circulating in the heat pump system 1 can be any suitable medium, such as for example R-134a, R-1234YF or R-744.

Figure 2:
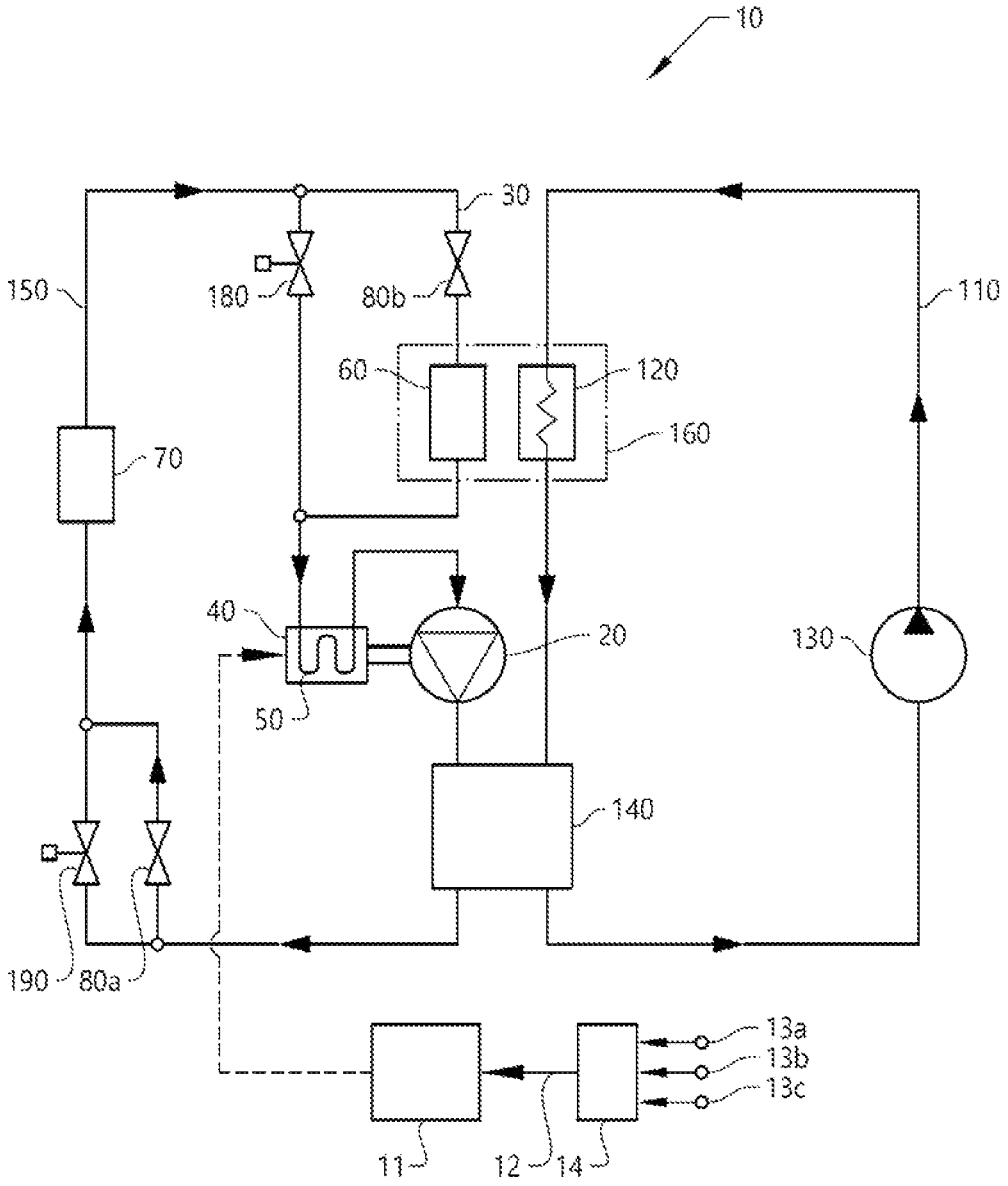
FIG. 2 is a schematic view of a variant of the heat pump system in FIG. 1.

In FIG. 2 another variant of the heat pump system 10 is shown. This heat pump system 10 can also be used in an electric vehicle application. In heating mode, i.e. when heating the passenger compartment 160 of a vehicle, a first circuit 150 of the heat pump system 10 interacts with another second circuit 110 having a heater core 120 for heating the passenger compartment 160 as schematically illustrated in FIG. 2. The heater core 120 is arranged in the second circuit 110, which could constitute a sub circuit also for heating batteries (not illustrated) of the vehicle, for instance. The working fluid of the second circuit can be water and is circulated by means of a pump 130 and heat is transferred to the passenger compartment 160 of the vehicle by means of the heater core 120. Further, an evaporator 70 in the heat pump system 10 is used for transferring heat from the surrounding to the working fluid 30 of the heat pump system and by means of a condenser 140 heat can be transferred from the first circuit 150 to the second circuit 110 provided with the heater core 120.

The evaporator 70 is suitably a combined evaporator-condenser device that can work as condenser when an evaporator 60 is used for lowering the temperature of the passenger compartment 160 in a cooling mode or AC mode.

In the heating mode, the working fluid 30 is then circulated in a way by-passing the evaporator 60. This can be performed with a first valve 180, a shut off valve for instance, being in an opened state. Further, the working fluid is circulated via a first pressure lowering device 80*a* arranged in the first circuit 150 between the condenser 140 and the evaporator 70.

For enabling the cooling mode where the evaporator-condenser device 70 is working as a condenser, the working fluid 30 can be circulated in a way by-passing the first pressure lowering device 80*a*. This can be performed with a second valve 190, a shut off valve for instance, being in an opened state, whereas the first shut off valve 180 is closed for circulating the working fluid via a second pressure lowering device 80*b* and the evaporator 60.

In the same way as described with reference to FIG. 1, the working fluid 30 in the heat pump system illustrated in FIG. 2 will also pass close to the electric motor 40 driving the compressor 20 by means of the heat recovering means 50 before entering the compressor 20. The heat recovering means 50 is suitably some kind of heat exchanger for transferring heat from the electric motor to the working fluid 30. Thus, the working fluid of the heat pump system functions as a coolant for the electric motor 40 driving the compressor 20.

Figure 3:
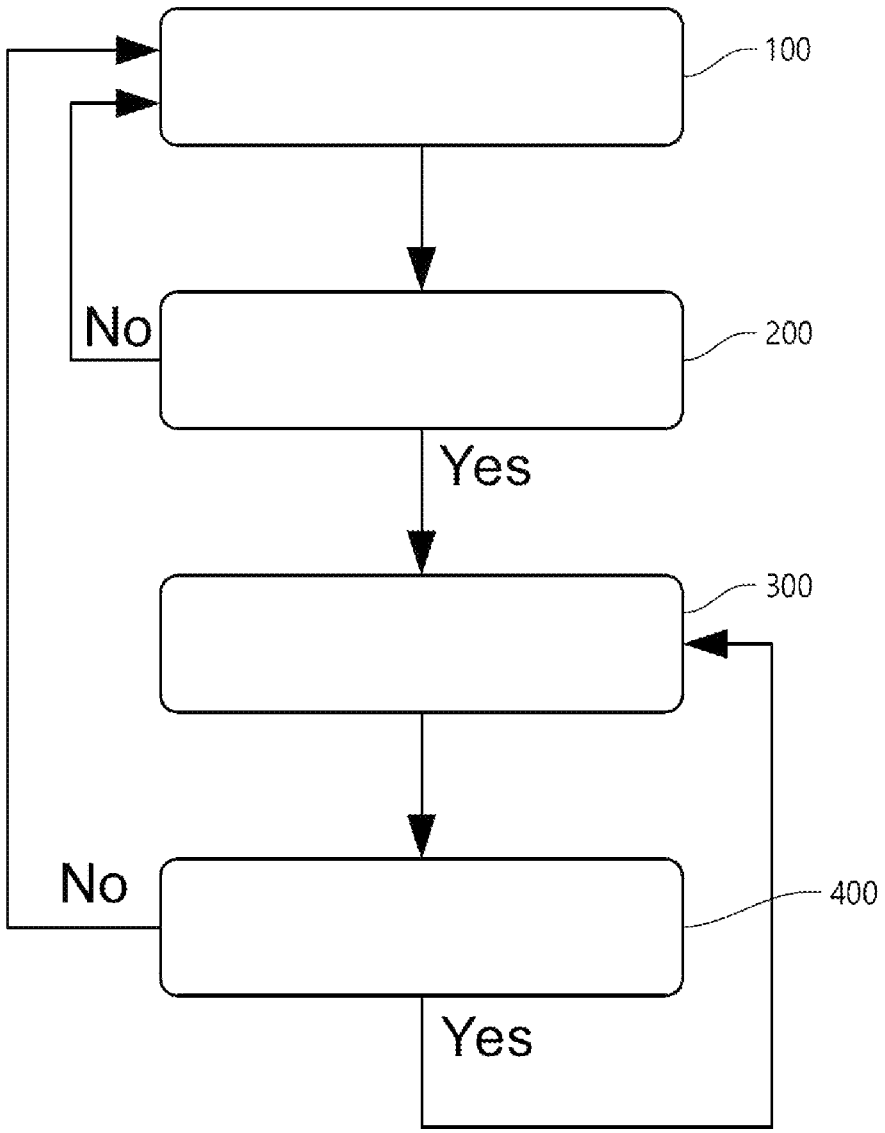
FIG. 3 is schematic flow chart illustrating one embodiment example of the method according to the invention.

In FIG. 3 one example embodiment of the method according to the invention is schematically illustrated in a flow chart. The method comprises the steps of providing a first control mode and a second control mode for the electric motor, and controlling the electrical motor in a way creating higher heat losses of the electric motor for a given output torque of the electric motor in the second control mode than in the first control mode, and recovering heat emitted from the electric motor by heating the working fluid.

Although the first control mode and/or the second control mode would possibly be selected by an operator, in the following example the control mode is automatically selected by means of a control unit on the basis of receiving a control signal.

As schematically illustrated in FIG. 3, in a first step 100 the electric motor is driven in the first control mode by a default setting. In the first control mode, the electric motor is preferably driven with highest possible efficiency for providing the output torque required by the load. This means that the electric motor has an operation point at or close to the MTPA-line of the electric motor. (MTPA=Maximum Torque Per Ampere.) Accordingly, the heat loss from the electric motor is minimized. Although the first control mode could be performed with various control methods, vector control is preferred. Vector control will give the highest efficiency. For example, a field-oriented control (FOC) and a proportional-integral (PI) controller can be used.

The electric motor is controlled according to the second control mode upon receiving a control signal 12 indicating that a predetermined condition is fulfilled. See also FIGS. 1 and 2. This condition can be for example a heating capacity demand on the heat pump system exceeding a threshold value. This threshold value can preferably correspond to the maximum heating capacity of the heat pump system when the electric motor is controlled according to the first control mode. Of course, this threshold value may vary for different operation conditions and applications. For evaluating if the condition is met, one or more physical quantities can be measured and compared to reference values. Accordingly, the control signal can be based on measurements of one or more physical quantities and any calculations required. For example, if the desired temperature in a passenger compartment of a vehicle cannot be reached, a control signal based on temperature measurements can be provided for indicating that the heating capacity of the heat pump system is not sufficient and that the control of the electric motor has to be switched to the second control mode.

For other predetermined conditions for using the second control mode, the heating capacity of the heat pump system may be fulfilled or not, or even be irrelevant, but still there is a need of increasing the temperature of the working fluid. Such additional heating of the working fluid can be required when starting up the system for avoiding liquid compression in the compressor or for defrosting the evaporator of the heat pump system.

For example, the electric motor can be controlled according to the second control mode upon receiving said control signal indicating an amount of the working fluid, to be entered into the compressor, being in liquid state exceeding a threshold value. Such indication can be provided by said control signal indicating a temperature of the working fluid and/or pressure of the working fluid below a threshold value. In other words; the temperature and/or the pressure of the working fluid can be used for indicating any risk of liquid compression in the compressor. Instead of measuring the temperature of the working fluid, the ambient temperature can be measured, since at least when the system is to be started the relationship between these temperatures is known. Only given as an example, for an ambient temperature below −5° C., the second control mode could be used. Furthermore, only given as an example, for a pressure of the working fluid below 2.5 bar, the second control mode could be used.

In a second step 200, it is checked if such a predetermined condition is fulfilled. If "YES", i.e. there is such a predetermined condition motivating the second control mode to be applied, then in a third step 300 the control of the electric motor is performed in accordance with the second control mode. Otherwise, if "NO", the first control mode is applied in the first step 100 until such a predetermined condition is fulfilled.

Provided that the electric motor is controlled in the second control mode, in a fourth step 400, it is checked if the predetermined condition is still fulfilled. If "YES", the second control mode is applied in the third step 300 until the predetermined condition has ceased, whereas if "NO", the first control mode is applied in the first step 100 until such a predetermined condition is fulfilled again. In addition, other conditions requiring the first control mode to be applied or the second mode to be ended can be used for overriding any predetermined condition discussed hereinabove and bringing the control strategy back to the first control mode. For example, in case the cooling of the electric motor is not sufficient the second control mode may not be allowed.

In the second control mode, the electric motor is driven to give lower efficiency than in the first control mode, and instead produce more heat for heating the working fluid. In order to increase the heat emitted from the electric motor, the electric motor is suitably controlled in a way resulting in a higher stator current for a given output torque of the electric motor in the second control mode than in the first control mode.

The electric motor is preferably controlled in a way creating higher heat losses of stator windings of the electric motor for a given output torque of the electric motor in the second control mode than in the first control mode. Since the heat emitted from the stator windings increases with the stator current in square, an increased stator current will have considerably impact on the heat creating capacity.

As already mentioned hereinabove, for controlling the electric motor, vector control is suitably applied. As an example, in FIG. 4 the torque provided by an electric motor is shown as a function of the electric current in a (d, q) coordinate system. When applying vector control, a stator current space vector can be defined in a rotating and time invariant (d, q) coordinate system. As illustrated in the upper half of the coordinate system, the torque is constant along one and the same line, where the torque line intersecting the q-axis at largest distance from the origin of the coordinate system represents the largest torque.

For a given current space vector in the coordinate system, the vector component along the q-axis is the torque producing component of the stator current, whereas the vector component along the d-axis is the magnetic flux linkage component of the stator current.

Figure 4:
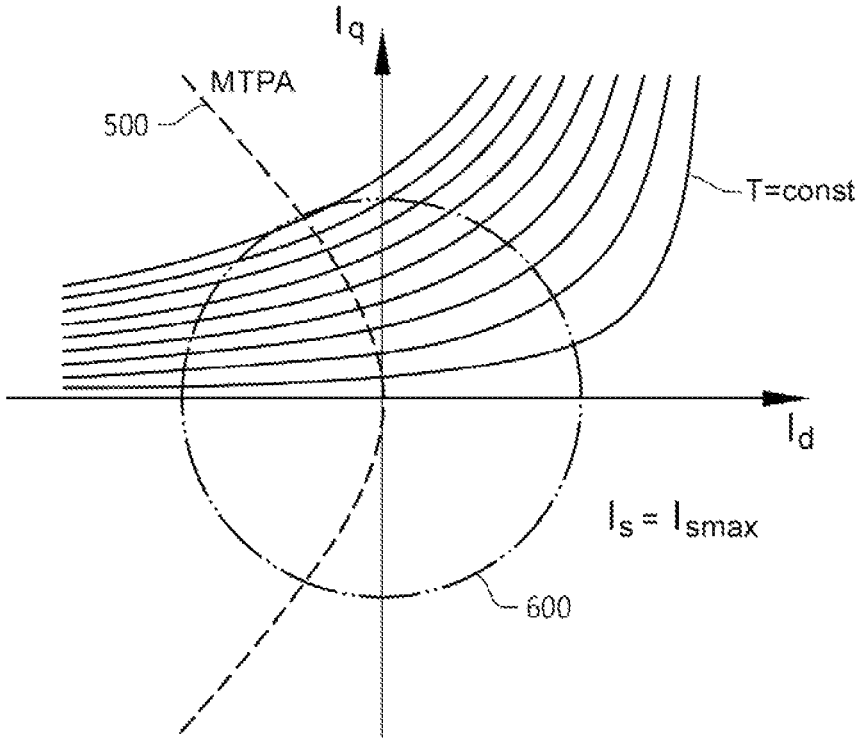
FIG. 4 is a diagram showing output torque of an electric motor as a function of a torque producing component of the stator current and a magnetic flux component of the stator current.

For each given torque line, an operation point requiring a minimum stator current can be found. This operation point gives—or at least comes very close to—the best motor efficiency for that given torque. The operation points requiring a minimum current for the respective torque are indicated in FIG. 4 as a dashed line 500. In other words; this line corresponds to the MTPA-line for the electric motor.

The circle 600 indicated with dotted lines in FIG. 4 shows the maximum stator current for different stator current space vectors. The point in the upper half of the coordinate system where the circle 600 and the line 500 intersect gives the largest output torque of the electric motor.

Figure 5:
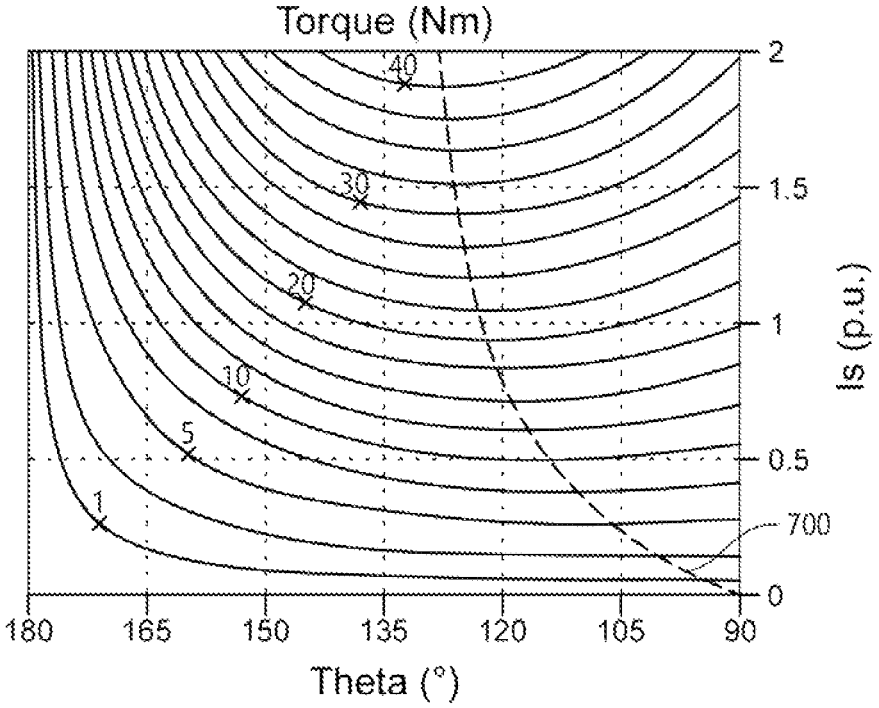
FIG. 5 is a diagram showing output torque of an electric motor as a function of the stator current and the stator current angle.

Another representation in a stationary coordinate system is shown as an example in FIG. 5. Here, the torque is shown as a function of the stator current Is and the stator current angle Theta. The stator current angle Theta is the angle by which the stator current is leading the stator magnetic flux. (In generator mode Theta is the angle by which the current is lagging relative to the magnetic flux.) The stator current Is is given in parts of the rated current that can be handled by the electric motor/compression system during continuous operation, i.e. 1 p.u. represents the rated current. FIG. 5 indicates that the electric motor can continuously supply approximately 21 Nm at 1 p.u.

In a similar way as in FIG. 4, a dashed line 700 in FIG. 5 indicates the minimum current required for different torques. If for example the compressor torque request is 10 Nm, it is possible to provide this torque using stator current Is of 0.5 p.u. at Theta=114 degrees. This operation is suitably used in the first control mode. In the second control mode Theta is changed for creating increased heat losses. For example, by using 1.0 p.u. current at Theta=163 degrees, the torque requirement of 10 Nm is still fulfilled. This motor operating point gives however rise to 4 times the resistive losses compared to most efficient point at the MTPA line.

Hereby considerably more heat is created while keeping the torque constant. During shorter times, also stator currents above rated current (>1 p.u.) may be used. Thus, the electric motor is preferably controlled with a first stator current angle in the first control mode and with a second stator current angle in the second control mode, for a given output torque of the electric motor, where the second stator current angle requires a higher stator current than the first stator current angle.

Different electric motors will have different performance and characteristics. Thus, the control of the electric motor has to be adapted accordingly. In many cases, the stator current $I_{s2}$ used in the second control mode is preferably in the range 1.1-10 times the stator current $I_{s1}$ in the first control mode, preferably 1.2-8 times $I_{s1}$, and often $I_{s2}$ is 1.5-2 times $I_{s1}$.

In the second control mode, both an increased and decreased stator current angle relative to the stator current angle in the first control mode can be used.

Suitably, the second stator current angle deviate from the first stator current angle by at least ±10 degrees, preferably at least ±15 degrees, and often the difference between the stator current angle Theta2 in the second control mode and the stator current angle Theta1 in the first control mode is within the range 15-50 degrees.

In other words; when operating the electric motor in a way using a second stator current angle that is larger than the first stator current angle, for a stator current angle Theta1 in the first control mode, a stator current angle Theta2 in the second control mode can be in the range 1.1-2 times Theta1, preferably Theta2 is 1.2-1.8 times Theta1.

As an alternative, or in addition to a control strategy giving heat losses of the stator windings, the electric motor can be controlled in a way creating higher heat losses of a stator core of the electric motor for a given output torque of the electric motor in the second control mode than in the first control mode. This can be performed by controlling the electric motor with a stator current having a substantially sinusoidal periodic waveform in the first control mode, and with a stator current having a non-sinusoidal periodic waveform in the second control mode. The electric motor is preferably controlled with the stator current having a substantially square waveform in the second mode.

As schematically illustrated in FIGS. 1 and 2, for performing the method as described herein, a control unit 11 for controlling the heat pump system is provided. The control unit is suitably connected to the power electronics of the electric motor for controlling the electric motor. The control unit may comprise one or more microprocessors and/or one or more memory devices or any other components for executing computer programs to perform the method. Thus, the control unit is preferably provided with a computer program for performing all steps of any embodiment of the method described hereinabove. Furthermore, the control unit can be part of a controller used also for other functions of the heat pump system and/or any other function of a vehicle or be provided as a separate unit.

As also described with reference to the method, the control unit is configured to provide a first control mode and a second control mode for the electric motor, and configured to control the electric motor in a way creating higher heat losses of the electric motor for a given output torque of the electric motor in the second control mode than in the first control mode.

The control unit 11 is suitably configured to control the electric motor according to the second control mode upon receiving a control signal 12 indicating that a predetermined condition is fulfilled. Such a control signal can be based on one or more input signals 13*a*, 13*b*, 13*c* from sensors and any calculations required. In FIGS. 1 and 2 a unit 14 for comparison and/or calculation of the input signals is arranged to produce the control signal 12. This unit 14 is depicted outside the control unit 11 but could of course be an integrated part of the control unit 11. The input signals 13*a*, 13*b*, 13*c* can be based on measurements of one or more physical quantities related to the heat pump system or other components of a vehicle or the surrounding to the heat pump system/vehicle.

It is to be understood that the present invention is not limited to the embodiments described above and illustrated in the drawings; rather, the skilled person will recognize that many changes and modifications may be made within the scope of the appended claims.

The invention claimed is:

1. A method for controlling a heat pump system, the heat pump system comprising a compressor for compressing a working fluid of the heat pump system and an electric motor for providing an output torque for driving the compressor, the method comprising the steps of:

transferring heat loss produced by the electric motor to the working fluid, providing a first control mode and a second control mode for the electric motor, and controlling the electrical motor to produce higher heat losses of the electric motor for a given output torque of the electric motor in the second control mode than in the first control mode.

2. The method according to claim 1, wherein the electric motor is controlled according to the second control mode upon receiving a control signal indicating that a predetermined condition is fulfilled.

3. The method according to claim 2, wherein the electric motor is controlled according to the second control mode upon receiving said control signal indicating a heating capacity demand on the heat pump system exceeding a threshold value.

4. The method according to claim 2, wherein the electric motor is controlled according to the second control mode upon receiving said control signal indicating an amount of the working fluid, to be entered into the compressor, being in liquid state exceeding a threshold value.

5. The method according to claim 4, wherein the electric motor is controlled according to the second control mode upon receiving said control signal indicating a temperature of the working fluid below a threshold value.

6. The method according to claim 4, wherein the electric motor is controlled according to the second control mode upon receiving said control signal indicating a pressure of the working fluid below a threshold value.

7. The method according to claim 1, wherein the electric motor is controlled in a way creating higher heat losses of stator windings of the electric motor for a given output torque of the electric motor in the second control mode than in the first control mode.

8. The method according to claim 7, wherein the electric motor is controlled with a first stator current angle in the first control mode and with a second stator current angle in the second control mode, for a given output torque of the electric motor, the second stator current angle requiring a higher stator current than the first stator current angle.

9. The method according to claim 8, wherein the electric motor is controlled with the second stator current angle being larger than the first stator current angle.

10. The method according to claim 8, wherein the electric motor is controlled with the second stator current angle being smaller than the first stator current angle.

11. The method according to claim 1, wherein the electric motor is controlled in a way creating higher heat losses of a stator core of the electric motor for a given output torque of the electric motor in the second control mode than in the first control mode.

12. The method according to claim 11, wherein the electric motor is controlled with a stator current having a sinusoidal periodic waveform in the first control mode, and with a stator current having a non-sinusoidal periodic waveform in the second control mode.

13. The method according to claim 12, wherein the electric motor is controlled with the stator current having a square waveform in the second mode.

14. The method according to claim 1, wherein the electric motor is controlled in a way resulting in a higher stator current for a given output torque of the electric motor in the second control mode than in the first control mode.

15. A non-transitory computer readable medium storing a computer program comprising program code for performing a method according to claim 1.

16. A control unit for controlling a heat pump system, the heat pump system comprising a compressor for compressing a working fluid of the heat pump system, an electric motor for providing an output torque for driving the compressor and a means for transferring heat loss produced by the electric motor to the working fluid, wherein the control unit is configured to provide a first control mode and a second control mode for the electric motor, and configured to control the electric motor to produce higher heat losses of the electric motor for a given output torque of the electric motor in the second control mode than in the first control mode.

17. The control unit according to claim 16, wherein the control unit is configured to control the electric motor according to the second control mode upon receiving a control signal indicating that a predetermined condition is fulfilled.

18. A vehicle comprising a control unit according to claim 16.

* * * * *